US005193369A

United States Patent [19]

Röse et al.

[11] Patent Number: 5,193,369

[45] Date of Patent: Mar. 16, 1993

[54] LUGGAGE LATCH

[75] Inventors: Klaus-Ulrich Röse, Iserlohn; Waldemar Ziebarth, Hemer, both of Fed. Rep. of Germany

[73] Assignee: Südhaus Schloss- und Beschlagtechnik GmbH & Co., Iserlohn, Fed. Rep. of Germany

[21] Appl. No.: 826,902

[22] Filed: Jan. 24, 1992

[30] Foreign Application Priority Data

Jan. 29, 1991 [DE] Fed. Rep. of Germany ..... 4102521

[51] Int. Cl.[5] ..... E05B 65/52; A45C 13/12

[52] U.S. Cl. ..... 70/71; 292/147; 292/DIG. 50

[58] Field of Search ..... 70/67, 76, 71, 74, 72, 70/69; 292/DIG. 48, DIG. 50, 147

[56] References Cited

U.S. PATENT DOCUMENTS

| | | | |
|---|---|---|---|
| 1,022,817 | 4/1912 | Binkley et al. | 70/71 |
| 1,187,751 | 6/1916 | Lotz | 292/DIG. 50 |
| 1,318,933 | 10/1919 | Teel | 292/DIG. 50 |
| 3,393,539 | 7/1968 | Gehrie | 70/71 |
| 3,543,545 | 12/1970 | Budzyn | 70/71 |
| 4,638,649 | 1/1987 | Chao | 70/71 |

FOREIGN PATENT DOCUMENTS

| | | | |
|---|---|---|---|
| 2031055 | 4/1980 | United Kingdom | 70/71 |

*Primary Examiner*—Richard E. Moore
*Assistant Examiner*—D. Boucher
*Attorney, Agent, or Firm*—Herbert Dubno; Andrew M. Wilford

[57] ABSTRACT

A latch for retaining together two parts of a piece of luggage has a latch element projecting from one of the parts, a housing mounted on the other part and shaped to receive the latch element, and a latch dog movable in the housing between a retaining position preventing the latch element, when engaged in the housing, from withdrawing from the housing and a freeing position permitting the latch element to withdraw from the housing. At least one operating element in the housing is displaceable in first and second nonparallel directions between an actuated and unactuated positions for, on displacement in the first direction and thereafter in the second direction, displacing the dog into the freeing position and for, on displacement in only one of the directions, leaving the dog in the retaining position. Thus if the operating element is accidentally hit by something the latch will not open.

7 Claims, 4 Drawing Sheets

LUGGAGE LATCH

FIELD OF THE INVENTION

The present invention relates to a latch for use on a piece of luggage. More particularly this invention concerns such a latch of the type particularly used on a document or attache case.

BACKGROUND OF THE INVENTION

A standard luggage latch has a latch element typically constituted as a hook tongue mounted on the edge of one part of the piece of luggage, typically the lid, and another part having a housing mounted on the other luggage part and incorporating a keeper mechanism that can receive and retain the tongue. An operating element on the housing is typically movable from a normal retaining position in which a latch dog engages the tongue and prevents it from being pulled out of the housing and a release position in which it permits free exit of the tongue from the housing. In addition a key- or combination-actuated mechanism is provided which can prevent displacement of the operating element into the release position to lock the latch in the latched position.

The main problem with such a system is that in the unlocked position it is possible for something to strike the operating element and pop the latch open, allowing the piece of luggage to spill open. This can happen while the piece of luggage is being handled normally and can represent a substantial inconvenience.

OBJECTS OF THE INVENTION

It is therefore an object of the present invention to provide an improved luggage latch.

Another object is the provision of such an improved luggage latch which overcomes the above-given disadvantages, that is which is not susceptible to accidental opening.

SUMMARY OF THE INVENTION

A latch according to this invention for retaining together two parts of a piece of luggage has a latch element projecting from one of the parts, a housing mounted on the other part and shaped to receive the latch element, and a latch dog movable in the housing between a retaining position preventing the latch element, when engaged in the housing, from withdrawing from the housing and a freeing position permitting the latch element to withdraw from the housing. At least one operating element in the housing is displaceable in first and second nonparallel directions between an actuated and unactuated positions for, on displacement in the first direction and thereafter in the second direction, displacing the dog into the freeing position and for, on displacement in only one of the directions, leaving the dog in the retaining position. Thus if the operating element is accidentally hit by something the latch will not open.

More particularly according to this invention there are two operating elements displaceable in the first and second directions. The first element is a depressible button and the second element is a slide. The depressible button is displaceable in the first direction between an outer unactuated position and an inner actuated position and the slide has an end exposed in the second direction that is covered in the outer position of the button and uncovered in the inner position of the button. Thus only when the button is depressed is the trailing end of the slide exposed so it can be pushed over in the second direction. The button has a width generally equal to that of the slide and the slide is displaceable away from the slide in the second direction between an unactuated position and an actuated position. Thus the entire end of the slide is protected and covered by the button, which itself is carried on the slide.

According to another feature of this invention a formation on the housing prevents the slide from being moved in the second direction from the unactuated to the actuate position when the button is in the outer position. In addition a lock on the slide is displaceable between a locked position preventing movement of the slide from the unactuated to the actuated position and an unlocked position permitting such movement.

BRIEF DESCRIPTION OF THE DRAWING

The above and other objects, features, and advantages will become more readily apparent from the following, reference being made to the accompanying drawing in which.

SPECIFIC DESCRIPTION

Figure 6:
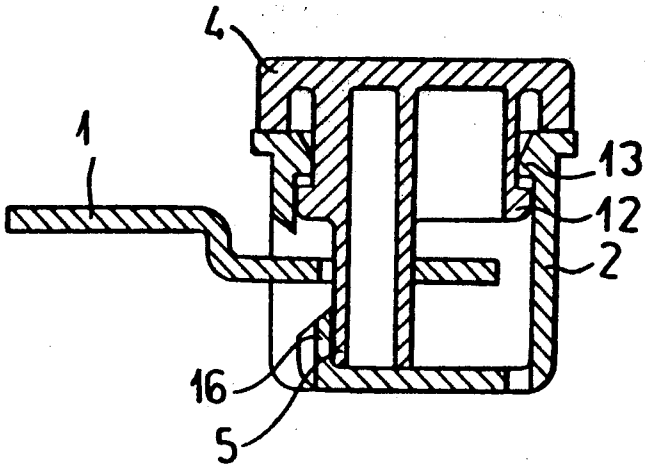
FIG. 6 is a cross section taken along line VI—VI of FIG. 2.
Figure 5:
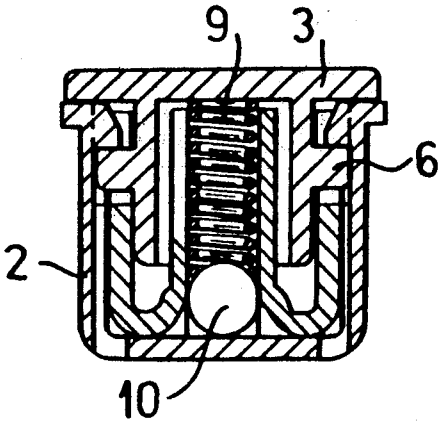
FIGS. 4 and 5 are cross sections taken along line IV—IV and V—V of 2 and 3, respectively.
Figure 4:
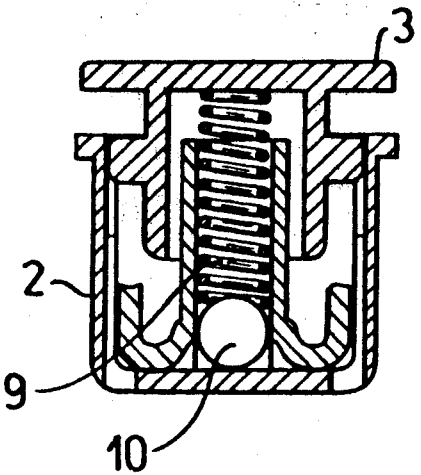

As seen in the drawing the latch according to this invention basically comprises a hook-type latch tongue 1 that is normally mounted on a lid L of a piece of luggage and a housing 2 normally mounted on a body B of the piece of luggage and provided with a button 3 depressible in a direction $D_3$ and a slide 4 movable in a direction $D_4$ perpendicular to the direction $D_3$. The housing 2 is formed with a window 22 into which the tongue 1 can fit and the slide 4 is provided with an integral retaining dog 5 that in the latched position of FIGS. 2, 4, and 6 engages in the cutout of the latch tongue 1 and prevents it from pulling out of the window 22. Longitudinally extending interfitting ridges 12 and 13 respectively on the slide 4 and housing 2 permit easy sliding of the slide 4 in the direction $D_4$. The button 3 is itself carried on the slide 4 and formations 14 and 15 permit it to move relative to the slide 4 only in the direction $D_3$.

Figure 1B:
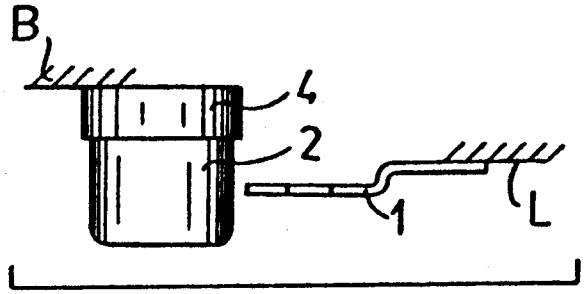
FIG. 1*b* is a side view of the entire latch with the parts spread for clarity of view.
Figure 1A:
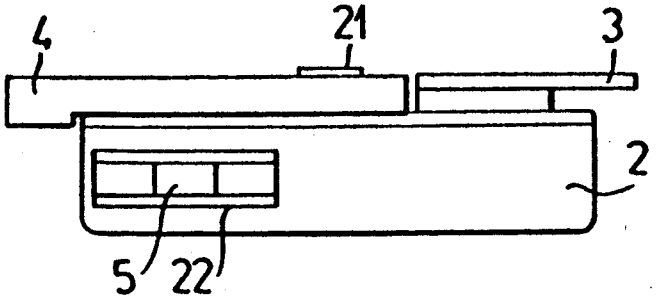
FIG. 1*a* is a top view of the body part of the latch in the latched position.
Figure 1C:
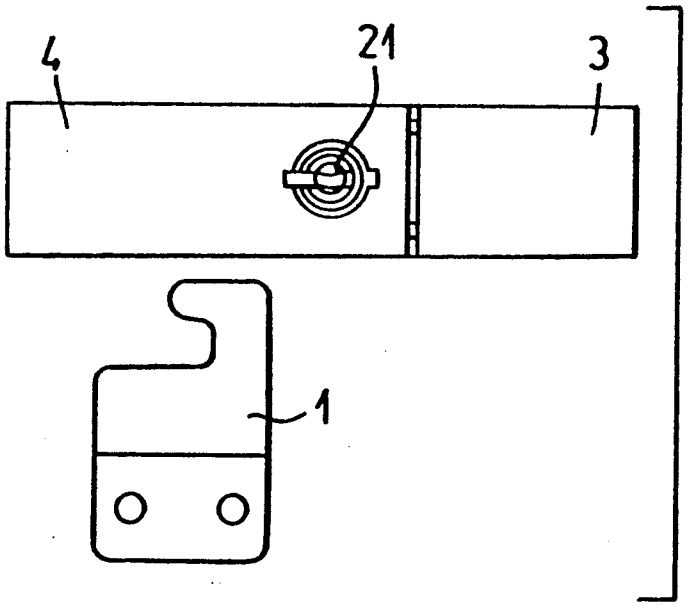
FIG. 1*c* is a front view of the latch as shown in FIG. 1*b*.
Figure 2:
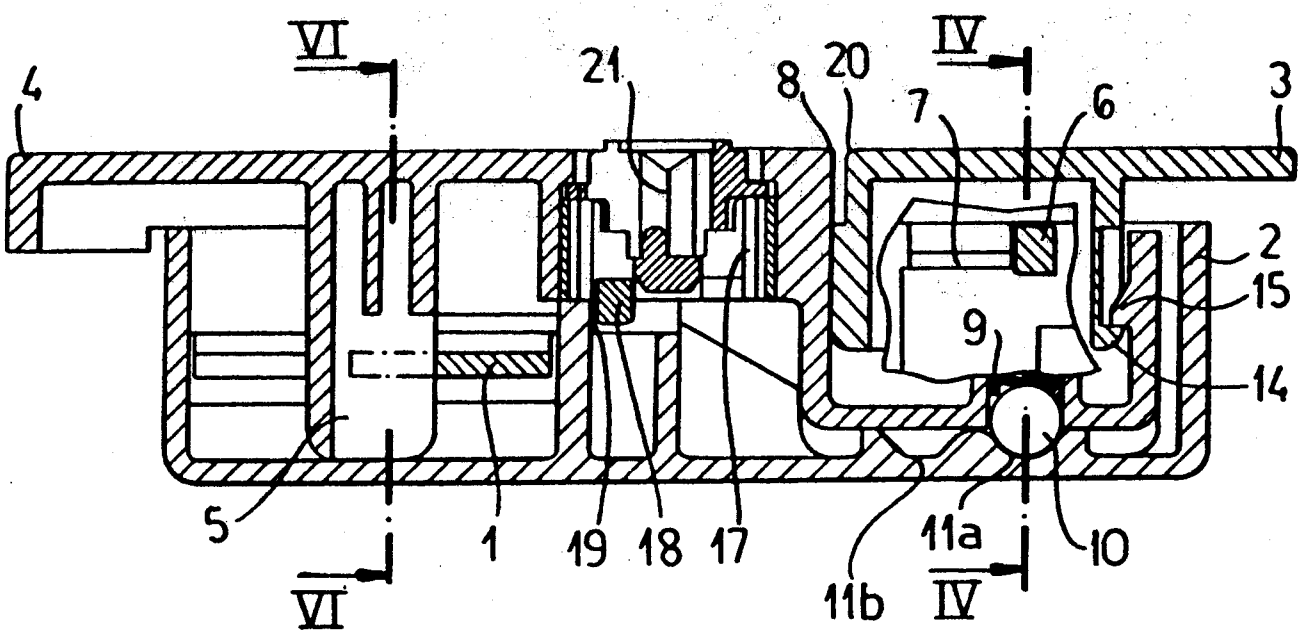
FIG. 2 is a longitudinal section through the latch in the locked and latched position.

A lock mechanism 21 here operated by a key is provided on the slide 4 and has a cylinder 17 provided with an eccentric pin or locking element 18 that can move through 180° on operation of the lock 21. When in the unlocked position of FIG. 3 the pin 18 is spaced relatively far in the direction $D_4$ from a wall 19 of the housing 2 so as to permit movement in the direction $D_4$ of the slide 4. When in the opposite position as shown in FIG. 2 it is very close to or even touches the surface 19 so that the slide 4 cannot move in the direction $D_4$.

The button 3 is provided with a pair of projections or pins 6 that extend perpendicular to the plane of both directions $D_3$ and $D_4$ and that coact with respective longitudinally extending ridge formations 7 on the longitudinal side walls of the slide 4. When the button 3 is in the outer unactuated position of FIG. 2 the pins 6 and formations 7 are longitudinally aligned in the direction $D_4$ so that in this position the slide 4 cannot move in the housing 2 in the direction $D_4$ from the latched position. When, however, the button 3 is depressed, the pins 6 move out of longitudinal alignment with the formations 7 and the slide 4 can be moved in the direction $D_4$. In addition when the button 3 is depressed its end surface 20 turned toward the slide 4 descends and exposes the oppositely facing end 8 of the slide 4, so that a user can get his finger on this surface 8 and push the slide over.

A ball 10 is urged in a guide in the button 3 by a spring 9 downwardly in the direction $D_3$ toward the floor of the housing 2 which is formed with a pair of upwardly open seats 11*a* and 11*b*. Thus this ball 10 acts as a retaining means for holding the slide 4 and button 3, which as mentioned above move together in the direction $D_4$, in either of the two end positions shown in FIGS. 2 and 3.

Figure 3:
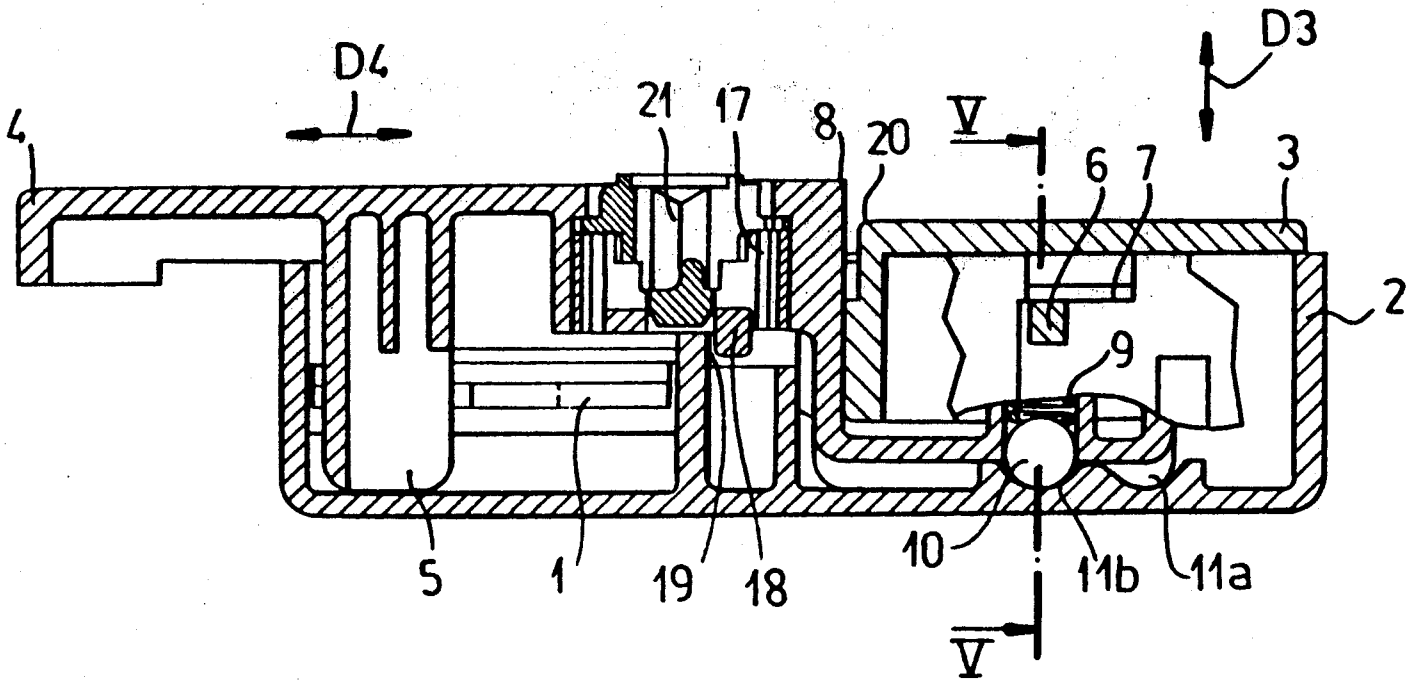
FIG. 3 is a view like FIG. 2 but with the latch in the unlocked and unlatched position.

To open the latch according to this invention first of all the lock 21 must be turned to the position of FIG. 3. Then the button 3 is depressed in the direction $D_3$ to move the formations 6 and 7 out of line with each other and to expose the slide end surface 8. Then the slide 4 is pushed in the direction $D_4$, that is away from the button 3, to pull the dog 5 out of the tongue 1 and thereby allow the latch to open.

To close the latch the tongue 1 is pushed in to the port 22 and the slide 4 is pushed in the direction $D_4$ toward the button 3. This action engages the dog 5 in the tongue 1 and slides the pins 6 past the ends of the ridges 7, allowing the button 3 to pop back out to the FIG. 2 position.

We claim:

1. A latch for retaining together two parts of a piece of luggage, the latch comprising:
   - a latch element projecting from one of the parts;
   - a housing mounted on the other part and shaped to receive the latch element;
   - a latch dog movable in the housing between a retaining position preventing the latch element, when engaged in the housing, from withdrawing from the housing and a freeing position permitting the latch element to withdraw from the housing; and
   - operating means on the housing including
     - a depressible button displaceable in a first direction between an outer unactuated position and an inner actuated position, and
     - a slide displaceable between an actuated position and an unactuated position in a second direction not parallel to the first direction and having an end exposed in the second direction in the outer position of the button and uncovered in the inner position of the button wherein upon displacement of the button from the respective unactuated position in the first direction and thereafter of the slide from the respective unactuated position in the second direction, the dog is displaced into the freeing position and wherein displacement in only one of the directions, leaves the dog in the retaining position.

2. The luggage latch defined in claim 1 wherein the button has a width generally equal to that of the slide and the slide is displaceable away from the button in the second direction between an unactuated position and an actuated position.

3. The luggage latch defined in claim 2 wherein the button is carried on the slide.

4. The luggage latch defined in claim 1, further comprising
   - spring-loaded retaining means for retaining the slide in the actuated position.

5. A latch for retaining together two parts of a piece of luggage, the latch comprising:
   - a latch element projecting from one of the parts;
   - a housing mounted on the other part and shaped to receive the latch element;
   - a latch dog movable in the housing between a retaining position preventing the latch element, when engaged in the housing, from withdrawing from the housing and a freeing position permitting the latch element to withdraw from the housing;
   - a button displaceable on the housing in a first direction between an outer unactuated position and an inner actuated position;
   - a slide displaceable on the housing in a second direction transverse to the first direction between actuated and unactuated positions, the slide having an end directed in the second direction toward the button and exposed only in the inner position of the button, whereby the slide can only be engaged to be pushed in the second direction when the button is in the inner position;
   - means including formations between the button and the slide for permitting the slide to move from its unactuated to its actuated position when the button is in its inner position; and
   - means between the dog and the slide for displacing the dog into the freeing position on displacement of the slide into the actuated position.

6. The luggage latch defined in claim 5 further comprising
   - means including a formation on the housing for preventing the slide from being moved in the second direction from the unactuated to the actuated position when the button is in the outer position.

7. The luggage latch defined in claim 5, further comprising
   - means including a lock on the slide displaceable between a locked position preventing movement of the slide from the unactuated to the actuated position and an unlocked position permitting such movement.

* * * * *